US008961049B2

(12) United States Patent
Byun

(10) Patent No.: US 8,961,049 B2
(45) Date of Patent: Feb. 24, 2015

(54) CONTAINER FOR LIQUID COSMETICS

(75) Inventor: Young-Kwang Byun, Seoul (KR)

(73) Assignee: Young-Kwang Byun (KR)

( * ) Notice: Subject to any disclaimer, the term of this patent is extended or adjusted under 35 U.S.C. 154(b) by 454 days.

(21) Appl. No.: 13/436,436

(22) Filed: Mar. 30, 2012

(65) Prior Publication Data

US 2012/0251220 A1 Oct. 4, 2012

(30) Foreign Application Priority Data

Apr. 1, 2011 (KR) ..... 10-2011-0030070

(51) Int. Cl.
*B43K 5/06* (2006.01)
*A46B 9/02* (2006.01)
*A46B 11/00* (2006.01)

(52) U.S. Cl.
CPC ..... *A46B 9/021* (2013.01); *A46B 11/0027* (2013.01); *A46B 2200/1053* (2013.01)
USPC ..... 401/175; 401/126; 401/277

(58) Field of Classification Search
CPC ..... A46B 9/021; A46B 11/0027; A46B 2200/1053
USPC ..... 401/126, 172–175, 277
See application file for complete search history.

(56) References Cited

U.S. PATENT DOCUMENTS

| | | | | |
|---|---|---|---|---|
| 4,997,299 | A * | 3/1991 | Ohba | 401/75 |
| 7,537,406 | B2 * | 5/2009 | Kurek et al. | 401/172 |
| 7,946,780 | B2 * | 5/2011 | Zhang | 401/277 |
| 8,206,050 | B2 * | 6/2012 | Prague | 401/175 |
| 8,506,193 | B1 * | 8/2013 | Zhang | 401/175 |
| 8,523,474 | B2 * | 9/2013 | Liu | 401/175 |

* cited by examiner

*Primary Examiner* — Kevin P Shaver
*Assistant Examiner* — Jennifer C Chiang
(74) *Attorney, Agent, or Firm* — Kaplan Breyer Schwarz & Ottesen, LLP

(57) ABSTRACT

A container for liquid cosmetics, wherein liquid cosmetic is filled both in a first bottle and a second bottle. A user can use the liquid cosmetic filled in the second bottle, and if necessary, the user can move the liquid cosmetic filled in the first bottle to the second bottle. That is, the container can be easily kept and used. In addition, a first bottle is allowed to be rotated in one direction only by stopper protrusions and stoppers so that the container can be used without errors.

8 Claims, 8 Drawing Sheets

CONTAINER FOR LIQUID COSMETICS

CROSS-REFERENCE TO RELATED APPLICATIONS

Korean patent application KR 10-2011-0030070, filed Apr. 1, 2011, is incorporated herein by reference.

FIELD OF THE INVENTION

The present invention relates to a container for liquid cosmetics, and more particularly, to a convenient container in which a liquid cosmetic can be easily stored in first and second bottles and transferred from the first bottle to the second bottle if necessary.

DESCRIPTION OF THE RELATED ART

Generally, liquid cosmetics such as lipsticks, lip glosses, mascaras, eyeliners, and nail polish are stored in tube containers (or hard containers), and a lower cap of a brush with bristles or hairs is coupled to such a container. Thus, a user can put a liquid cosmetic on the brush for makeup.

In the related art, however, a liquid cosmetic may unnecessarily come out of such a tube container if the tube container is carelessly pushed. That is, such containers are not easy to carry or store.

Furthermore, in the related art, users have to buy a new liquid cosmetic container if a liquid cosmetic filled in the liquid cosmetic container is used up.

SUMMARY OF THE INVENTION

Accordingly, the present invention is directed to a container for liquid cosmetics that substantially obviates one or more problems due to limitations and disadvantages of the related art. In the container, a liquid cosmetic can be stored in first and second bottles and transferred from the first bottle to the second bottle if the liquid cosmetic filled in the second bottle is used up, so that liquid cosmetics can be easily stored in the container and conveniently used.

The present invention provides a container for liquid cosmetics, the container including: a cylindrical body including openings at both ends thereof; a lining rod including a lower connection part inserted in one of the openings of the body, and an inner liquid cosmetic passage; a lining screw bar including an upper head part coupled to the connection part, an outer screw part, and an inner liquid cosmetic passage; a first bottle filled with a liquid cosmetic and rotatably coupled to a lower part of the body; a holder slidably disposed in the first bottle and screw-coupled to the lining screw bar so as to be moved down along the lining screw bar for pushing the liquid cosmetic of the first bottle into the inner liquid cosmetic passages when the first bottle is rotated; a mascara brush coupled to an upper end of the lining rod; and a second bottle detachably coupled to an upper part of the body.

If the first bottle is turned (rotated) while the body is held, the holder may be moved down along the lining screw bar to push the liquid cosmetic of the first bottle to the mascara brush through the liquid cosmetic passages.

A plurality of stopper protrusions may be formed along an inner surface of the body at regular intervals, and stoppers corresponding to the stopper protrusions may be formed on an upper outer surface of the first bottle, so as to allow rotation of the first bottle in one direction only.

A screw part may be formed on an inlet part of the second bottle for screw-coupling between the second bottle and the body.

An elastically deformable O-ring may be disposed on a lower part of the holder and may make contact with an inner surface of the first bottle.

The lining rod and the lining screw bar may have polygonal coupling structures at joint regions thereof for preventing slipping.

An orifice (hole) may be formed in an upper part of the lining screw bar, and a ball may be held in the orifice by an elastic spring to prevent a reverse flow of the liquid cosmetic.

As described above, according to the present invention, a liquid cosmetic is filled both in the first bottle and the second bottle. Thus, normally, a user can use the liquid cosmetic filled in the second bottle, and if necessary, the user can move the liquid cosmetic filled in the first bottle to the second bottle. That is, the container 100 of the present invention can be easily kept and used.

In addition, according to the present invention, the first bottle is allowed to be rotated in one direction only by the stopper protrusions and the stoppers so that the container can be used without errors.

In addition, the ball and the spring prevent the liquid cosmetic filled in the container from flowing in a reverse direction.

DETAILED DESCRIPTION OF THE INVENTION

Hereinafter, a container for liquid cosmetics will be described with reference to the accompanying drawings according to exemplary embodiments of the present invention.

Figure 1:
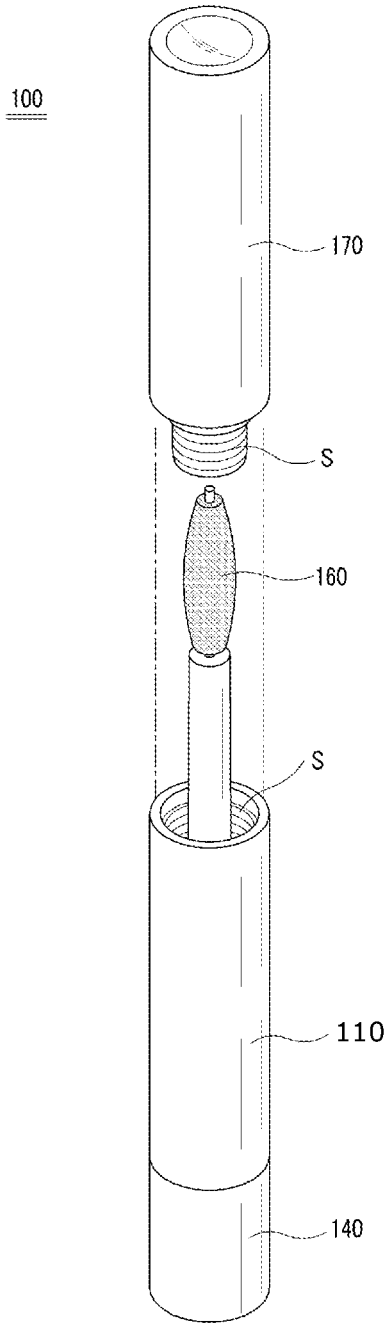
FIG. 1 is a perspective view illustrating a separated state of a liquid cosmetic container according to an exemplary embodiment of the present invention.
Figure 2:
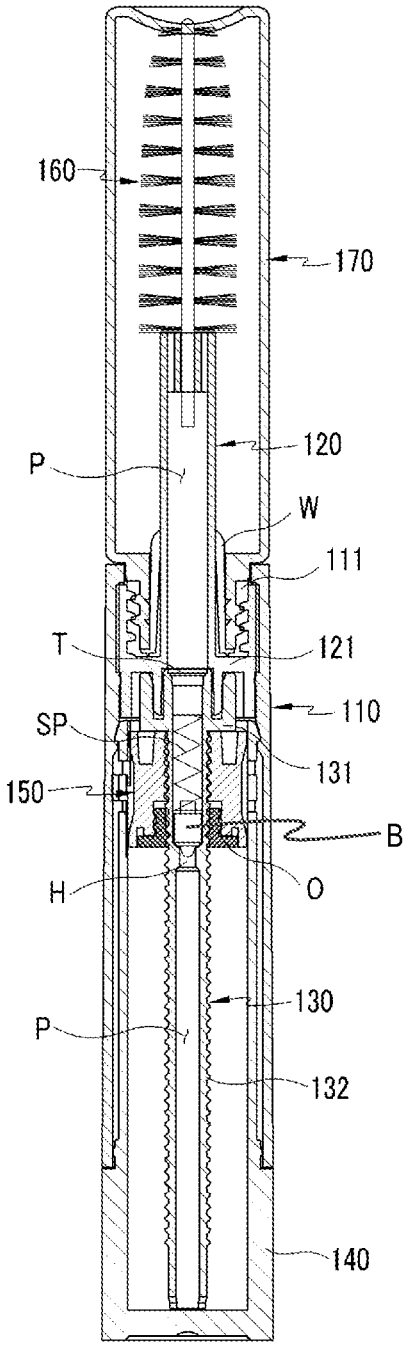
FIG. 2 is a vertical sectional view illustrating the liquid cosmetic container according to an exemplary embodiment of the present invention.
Figure 3:
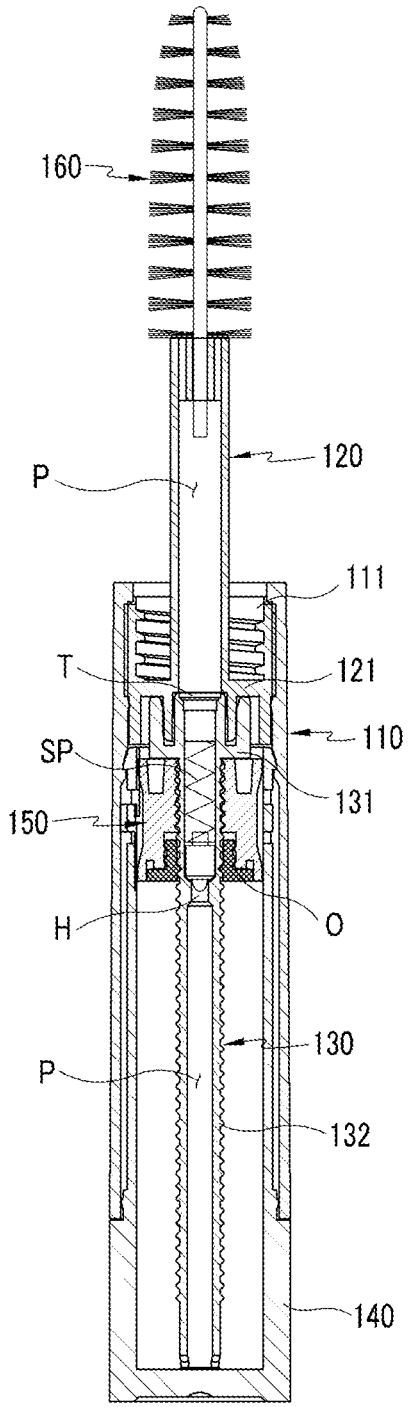
FIG. 3 is a vertical sectional view illustrating the liquid cosmetic container of FIG. 2 after a second bottle is separated from the liquid cosmetic container.
Figure 4:
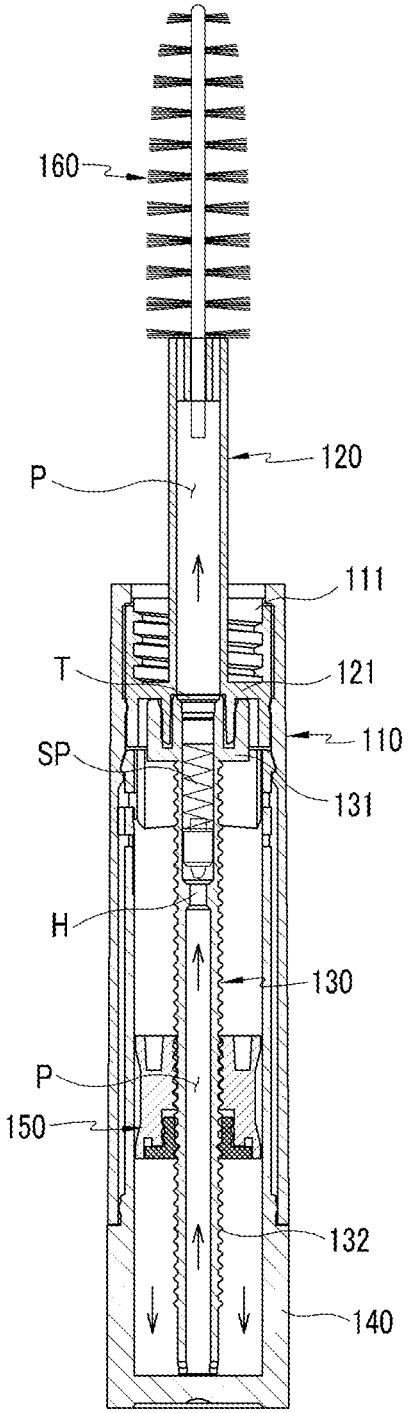
FIG. 4 is a vertical sectional view illustrating the liquid cosmetic container of FIG. 3 when a holder of the liquid cosmetic container is moved down.
Figure 5:
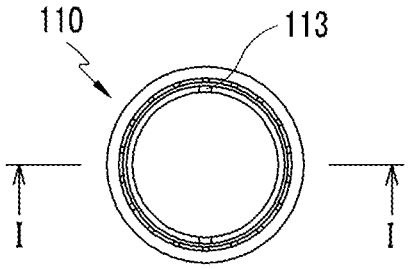
FIG. 5 is a plan view illustrating a body of the liquid cosmetic container illustrated in FIG. 1.
Figure 6:
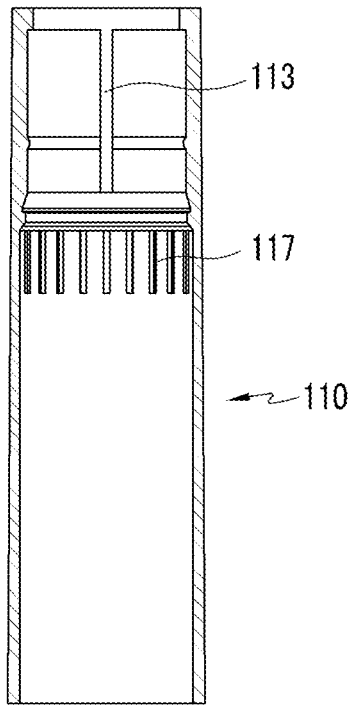
FIG. 6 is a sectional view taken along line I-I' of FIG. 5.
Figure 7:
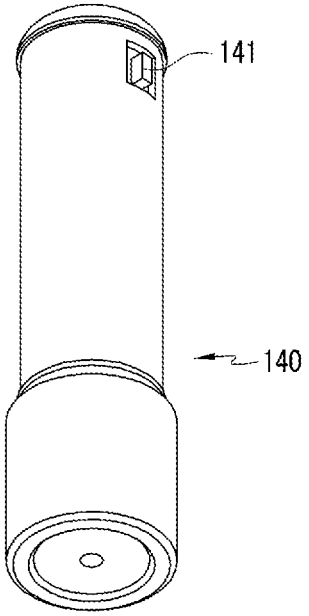
FIG. 7 is a perspective view illustrating a first bottle.
Figure 8:
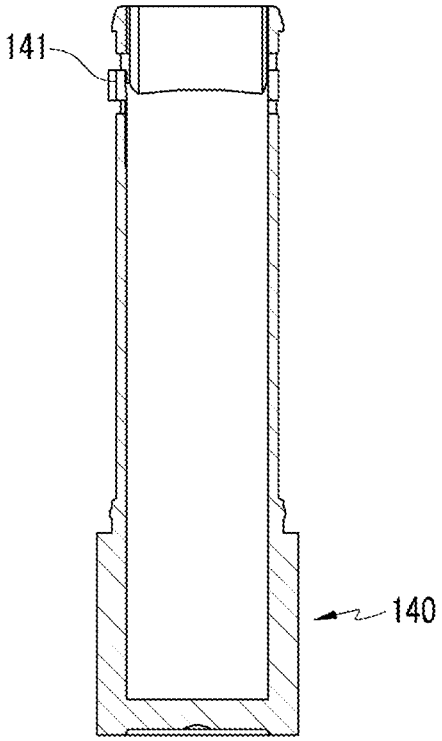
FIG. 8 is a vertical sectional view illustrating the second bottle according to an embodiment of the present invention.
Figure 9:
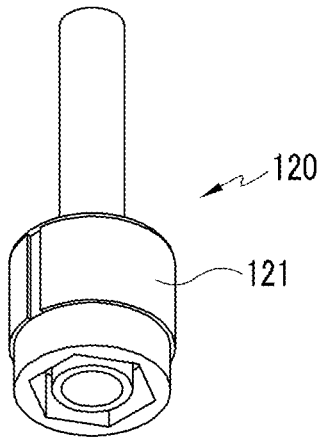
FIG. 9 is a perspective view illustrating a lining rod according to an embodiment of the present invention.
Figure 10:
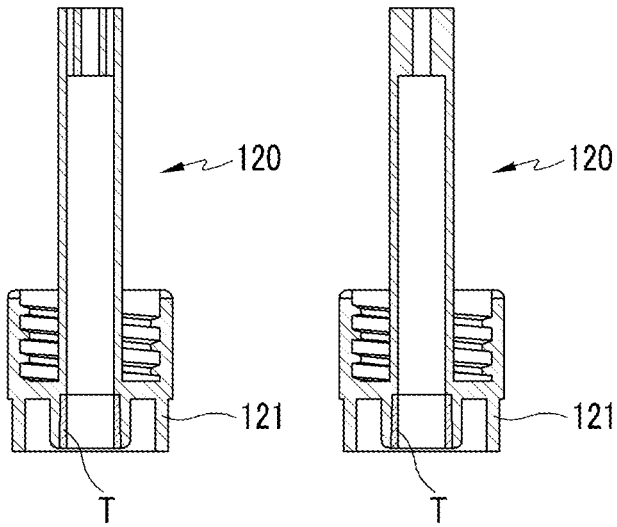
FIG. 10 illustrates vertical sections of the lining rod of FIG. 9.
Figure 11:
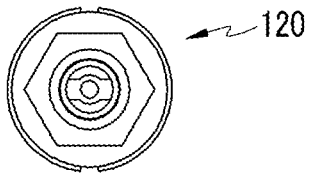
FIG. 11 is a bottom view illustrating the lining rod of FIG. 9.
Figure 12:
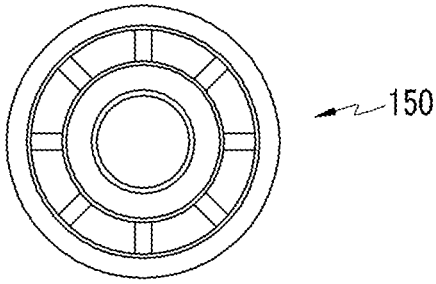
FIG. 12 is a plan view illustrating the holder according to an embodiment of the present invention.
Figure 13:
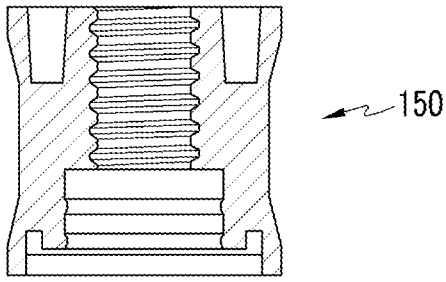
FIG. 13 is a sectional view illustrating the holder of FIG. 12.
Figure 14:
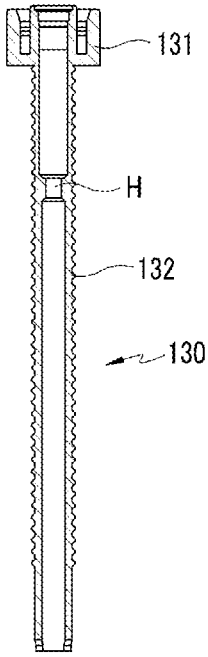
FIG. 14 is a vertical sectional view illustrating a lining screw bar according to an embodiment of the present invention.

FIG. 1 is a perspective view illustrating a separated state of a liquid cosmetic container according to an exemplary embodiment of the present invention; FIG. 2 is a vertical sectional view illustrating the liquid cosmetic container according to an exemplary embodiment of the present invention; FIG. 3 is a vertical sectional view illustrating the liquid cosmetic container of FIG. 2 after a second bottle is separated from the liquid cosmetic container; FIG. 4 is a vertical sectional view illustrating the liquid cosmetic container of FIG. 3 when a holder of the liquid cosmetic container is moved down; FIG. 5 is a plan view illustrating a body of the liquid cosmetic container illustrated in FIG. 1; FIG. 6 is a sectional view taken along line I-I' of FIG. 5; FIG. 7 is a perspective view illustrating a first bottle; FIG. 8 is a vertical sectional view illustrating the second bottle according to an embodiment of the present invention; FIG. 9 is a perspective view illustrating a lining rod according to an embodiment of the present invention; FIG. 10 illustrates vertical sections of the lining rod of FIG. 9; FIG. 11 is a bottom view illustrating the lining rod of FIG. 9; FIG. 12 is a plan view illustrating the holder according to an embodiment of the present invention; FIG. 13 is a sectional view illustrating the holder of FIG. 12; and FIG. 14 is a vertical sectional view illustrating a lining screw bar according to an embodiment of the present invention.

Referring to FIGS. 1 to 14, according to an embodiment of the present invention, a container 100 for liquid cosmetics includes: a cylindrical body 110 having openings 111 at both ends thereof; a lining rod 120 having a lower connection part 121 inserted in the opening 111 of the body 110, and an inner liquid cosmetic passage (P); a lining screw bar 130 having an upper head part 131 coupled to the connection part 121, an outer screw part 132, and an inner liquid cosmetic passage (P); a first bottle 140 filled with a liquid cosmetic and rotatably coupled to a lower part of the body 110; a holder 150 slidably disposed in the first bottle 140 and screw-coupled to the lining screw bar 130 so as to be moved down along the lining screw bar 130 for pushing the liquid cosmetic of the first bottle 140 into the inner liquid cosmetic passages (P) when the first bottle 140 is rotated; a mascara brush 160 coupled to an upper end of the lining rod 120; and a second bottle 170 detachably coupled to an upper portion of the body 110. A wafer W is disposed at an inlet part of the second bottle 170.

If the first bottle 140 is turned (rotated) while the body 110 is held, the holder 150 is moved down along the lining screw bar 130 to push the liquid cosmetic of the first bottle 140 to the mascara brush 160 through the liquid cosmetic passages (P).

A plurality of stopper protrusions 117 are formed along the inner surface of the body 110 at regular intervals, and stoppers 141 corresponding to the stopper protrusions 117 are formed on the upper outer surface of the first bottle 140, so as to allow rotation of the first bottle 140 in one direction only.

Screw parts (S) are formed on inlet parts of the body 110 and the second bottle 170 so that the second bottle 170 can be screw-coupled to an upper part of the body 110.

An O-ring (O) is disposed on a lower part of the holder 150. The O-ring (O) makes contact with the inner surface of the first bottle 140 and is elastically deformable.

To prevent slipping of the lining rod 120, the lower part of the lining rod 120 has a polygonal shape supported by inner protrusions 113 of the body 110, and the upper part of the lining screw bar 130 has a polygonal shape corresponding to the polygonal lower part of the lining rod 120.

An orifice (H) is formed in an upper inner part of the lining screw bar 130, and a ball (B) is held in the orifice (H) by an elastic spring (SP), so as to prevent a reverse flow of the liquid cosmetic.

In detail, if the liquid cosmetic flows reversely in the liquid cosmetics passages (P) (in a direction from the second bottle 170 to the first bottle 140), the orifice (H) is closed by the ball (B), and if the liquid cosmetic flows forward in the liquid cosmetics passages (P) (in a direction from the first bottle 140 to the second bottle 170), the ball (B) is moved against the spring (SP) to open the orifice (H). In this way, a reverse flow of the liquid cosmetic can be effectively prevented.

A tube (T) is disposed in the connection part 121 to prevent leakage of the liquid cosmetic.

An exemplary operation of the liquid cosmetic container 100 will now be explained.

If a liquid cosmetic is in the second bottle 170, the liquid cosmetic can be applied to eyelashes using the mascara brush 160 after opening the second bottle 170.

If it is necessary to use the liquid cosmetic filled in the first bottle 140 because the liquid cosmetic in the second bottle 170 is insufficient, the liquid cosmetic filled in the first bottle 140 can be supplied to the second bottle 170. For this, a user can rotate the first bottle 140 while holding the body 110. At this time, the first bottle 140 can be rotated only in one direction owing to the stopper protrusions 117 and the stoppers 141.

If the first bottle 140 is rotated to some degree, the liquid cosmetic filled in the first bottle 140 is pushed into the liquid cosmetics passages (P) as the holder 150 is moved down. At this time, the O-ring (O) is brought into elastic contact with the inner surface of the first bottle 140 as well as the upper outer surface of the holder 150 being brought into elastic contact with the inner surface of the first bottle 140, so that the liquid cosmetic can be clearly pushed down along the inner surface of the first bottle 140.

The liquid cosmetic compressed by the holder 150 is moved upward in the liquid cosmetics passages (P) and is supplied to the mascara brush 160 through an outlet (opening) of the lining rod 120, so that a user can apply the liquid cosmetic to her eyelashes.

According to the present invention, if the liquid cosmetic flows reversely in the liquid cosmetics passages (P) (in a direction from the second bottle 170 to the first bottle 140), the orifice (H) is closed by the ball (B), and if the liquid cosmetic flows forward in the liquid cosmetics passages (P) (in a direction from the first bottle 140 to the second bottle 170), the ball (B) is moved against the spring (SP) to open the orifice (H). Thus, a reverse flow of the liquid cosmetic can be effectively prevented.

As described above, according to the present invention, a liquid cosmetic is filled both in the first bottle 140 and the second bottle 170. Thus, normally, a user can use the liquid cosmetic filled in the second bottle 170, and if necessary, the user can move the liquid cosmetic filled in the first bottle 140 to the second bottle 170. That is, the container 100 of the present invention can be easily kept and used.

In addition, according to the present invention, the first bottle 140 is allowed to be rotated in one direction only by the stopper protrusions 117 and the stoppers 141 so that the container 100 can be used without errors.

In addition, the ball (B) and the spring (SP) prevent the liquid cosmetic filled in the container 100 from flowing in a reverse direction.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A container for liquid cosmetics, comprising:

a cylindrical body including openings at both ends thereof;

a lining rod including a lower connection part inserted in one of the openings of the body, and an inner liquid cosmetic passage;

a lining screw bar including an upper head part coupled to the connection part, an outer screw part, and an inner liquid cosmetic passage;

a first bottle filled with a liquid cosmetic and rotatably coupled to a lower part of the body;

a holder slidably disposed in the first bottle and screw-coupled to the lining screw bar so as to be moved down along the lining screw bar for pushing the liquid cosmetic of the first bottle into the inner liquid cosmetic passages when the first bottle is rotated;

a mascara brush coupled to an upper end of the lining rod; and a second bottle detachably coupled to an upper part of the body.

2. The container of claim 1, wherein if the first bottle is turned (rotated) while the body is held, the holder is moved down along the lining screw bar to push the liquid cosmetic of the first bottle to the mascara brush through the liquid cosmetic passages.

3. The container of claim 1, wherein a plurality of stopper protrusions are formed along an inner surface of the body at regular intervals, and stoppers corresponding to the stopper protrusions are formed on an upper outer surface of the first bottle, so as to allow rotation of the first bottle in one direction only.

4. The container of claim 1, wherein a screw part is formed on an inlet part of the second bottle for screw-coupling between the second bottle and the body.

5. The container of claim 1, wherein an elastically deformable O-ring is disposed on a lower part of the holder and makes contact with an inner surface of the first bottle.

6. The container of claim 1, wherein the lining rod and the lining screw bar have polygonal coupling structures at joint regions thereof for preventing slipping.

7. The container of claim 1, wherein an orifice is formed in an upper part of the lining screw bar, and a ball is held in the orifice by an elastic spring to prevent a reverse flow of the liquid cosmetic.

8. The container of claim 1, wherein a wafer is disposed at an inlet part of the second bottle.

* * * * *